United States Patent [19]

Vaughn

[11] 3,993,139

[45] Nov. 23, 1976

[54] MOBILE HOME FIRE EXTINGUISHING SYSTEM

[76] Inventor: Eugene Sidney Vaughn, Rte. 4, Hunt Road, Douglasville, Ga. 30134

[22] Filed: Sept. 17, 1975

[21] Appl. No.: 614,150

[52] U.S. Cl. ..... 169/62; 239/209

[51] Int. Cl.[2] ..... A62C 35/12; B05B 15/06

[58] Field of Search ..... 169/54, 62; 239/289, 239/208, 209, 172

[56] References Cited

UNITED STATES PATENTS

| | | | |
|---|---|---|---|
| 218,100 | 7/1879 | Whyler | 239/208 X |
| 1,644,603 | 10/1927 | O'Neill | 239/208 X |
| 1,831,880 | 11/1931 | Pierce | 239/208 X |
| 2,017,841 | 10/1935 | Coleman | 239/208 X |
| 2,560,269 | 7/1951 | Berner | 169/62 X |
| 3,050,134 | 8/1962 | Multin | 239/209 X |
| 3,847,392 | 11/1974 | Horwinski | 239/209 X |
| 3,854,535 | 12/1974 | Kehr et al. | 239/208 X |
| 3,884,308 | 5/1975 | Green | 169/62 |
| 3,892,277 | 7/1975 | Curran | 239/209 X |

*Primary Examiner*—Robert S. Ward, Jr.
*Attorney, Agent, or Firm*—Robert B. Kennedy

[57] ABSTRACT

A fire extinguishing system is disclosed for a mobile home having a roof, side walls and a floor enclosing living spaces to which water may be supplied through a water line. The fire extinguishing system includes a trunk line mounted to the roof connected with the water line, a plurality of branch lines coupled with the trunk line and extending down through openings in the roof into the living spaces, means for inhibiting water exterior the branch and trunk lines from passing through the roof openings, and a plurality of heat responsive sprinkler heads mounted to the plurality of branch lines within the living spaces.

7 Claims, 6 Drawing Figures

MOBILE HOME FIRE EXTINGUISHING SYSTEM

BACKGROUND OF THE INVENTION

This invention relates generally to mobile homes, and particularly to mobile home fire protection systems.

Fire is an ever present danger to mobile home owners and dwellers. Though mobile homes today are much larger than those of the past, they nevertheless remain relatively compact in size for habitation. Materials used in their construction are flammable. Access doors are limited in number and location. The overall construction of mobile homes today thus renders them highly susceptible to fire. In the event of an actual fire, inhabitants fine themselves in an unusually precarious environment where the fire can spread very rapidly generating intense heat. Unless immediately brought under control, such a fire usually completely consumes the mobile home in a matter of a few minutes.

Accordingly, it is a general object of the present invention to provide a mobile home fire extinguishing system.

More specifically, it is an object of the present invention to provide a fire extinguishing system for a mobile home which may be readily installed upon preconstructed mobile homes.

Another object of the invention is to provide a fire extinguishing system for a preconstructed mobile home which may be installed with substantial alteration in the aesthetic appearance of the home.

Another object of the invention is to provide a fully automatic fire extinguishing system for a mobile home.

Another object of the invention is to provide a fire extinguishing system for a mobile home which is generally insusceptible to freeze damage.

Yet another object of the invention is to provide a fire extinguishing system for a mobile home of the double-wide type which does not substantially impede the disassemblement or reassemblement of the home.

SUMMARY OF THE INVENTION

In one form of the invention a fire extinguishing system is provided for a mobile home having a roof, side walls and a floor enclosing living spaces to which water may be supplied through a water line. The fire extinguishing system includes a trunk line mounted to the roof connected with the water line. A plurality of branch lines are coupled with the trunk line extending down through openings in the roof into the living spaces. Means are provided for inhibiting water exterior the branch and trunk lines from passing through the roof opening. A plurality of heat responsive sprinkler heads are mounted to the branch lines within the living spaces.

DETAILED DESCRIPTION OF THE DRAWING

Figure 1:
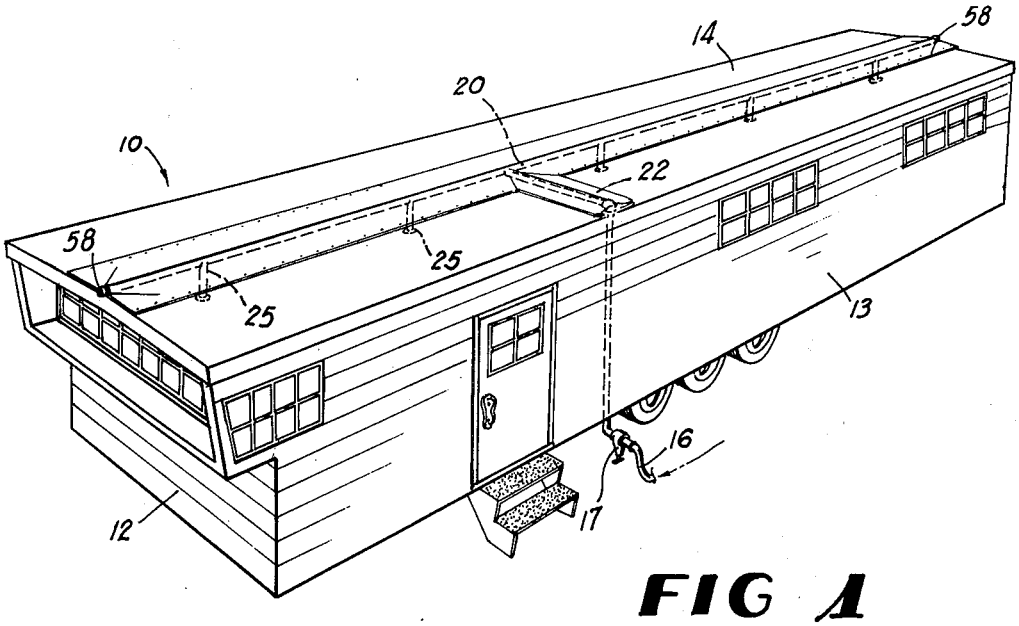
FIG. 1 is a perspective view of a mobile home having a fire extinguishing system installed therein embodying principles of the present invention.

Referring now in more detail to the drawing, there is shown a conventional mobile home 10 having two end walls 12, two side walls 13, a roof 14 and a floor 15. A water line 16 extending from an unshown water supply is seen to terminate beneath a side wall 13. A pressure regulator valve 17 is provided where the water line extends from a well. From the pressure valve an unshown auxiliary water supply line extends into the mobile home to supply home facilities with water.

Figure 2:
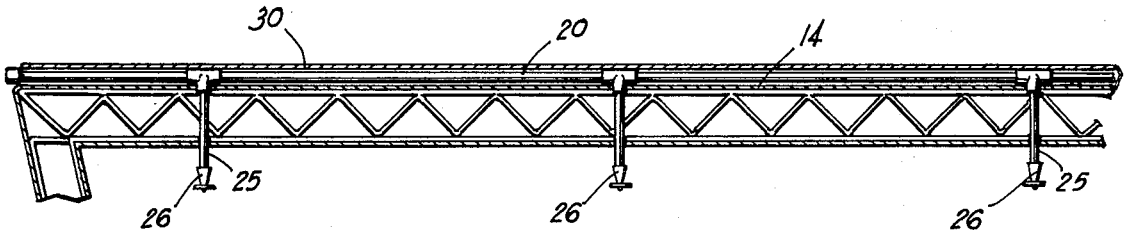
FIG. 2 is a longitudinal cross-sectional view of an upper portion of the mobile home shown in FIG. 1.
Figure 3:
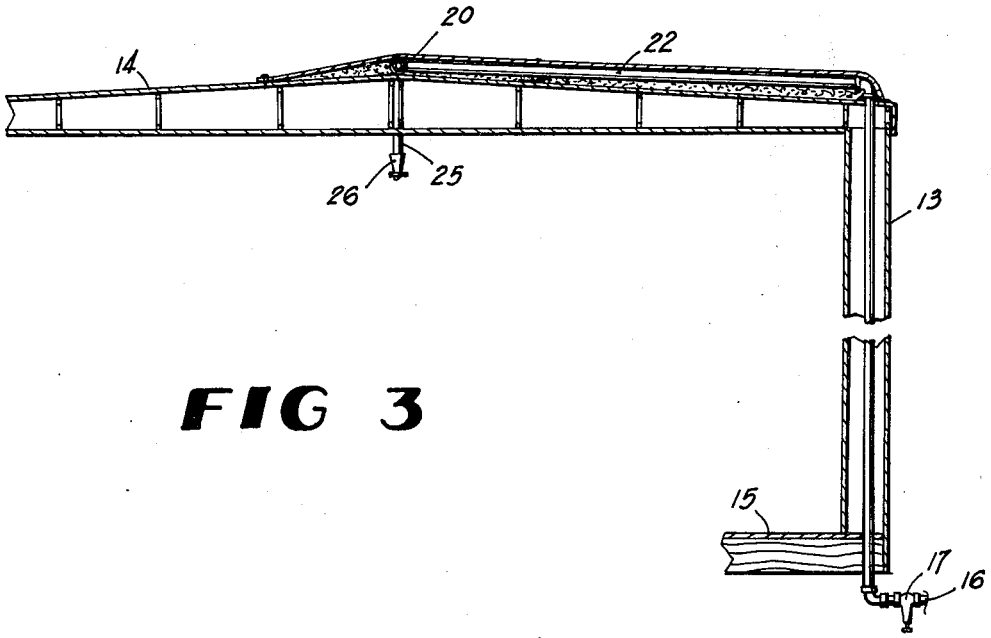
FIG. 3 is a transverse, cross-sectional view of a portion of the mobile home shown in FIG. 1.

As may be seen more clearly by reference to FIGS. 2 and 3, the mobile home is provided with a fire extinguishing system which includes a trunk water line or conduit 20 mounted atop home roof 14 generally along the longitudinal centerline thereof. Trunk line 20 is coupled with water line 15 by means of a feeder line or conduit 22 which extends from the trunk line above roof 14 and then down through the void provided by the double panel construction of side wall 13. Five branch lines or conduits 25 extend downwardly from trunk line 20 through five small openings provided in the roof and ceiling suspended therebeneath. Conventional heat sensitive sprinkler heads 26 are mounted to the lowermost end of each branch line 25 within the living space of the mobile home. Preferably, a sprinkler head and branch line is located in each home compartment including, of course, the kitchenette.

Figure 4:
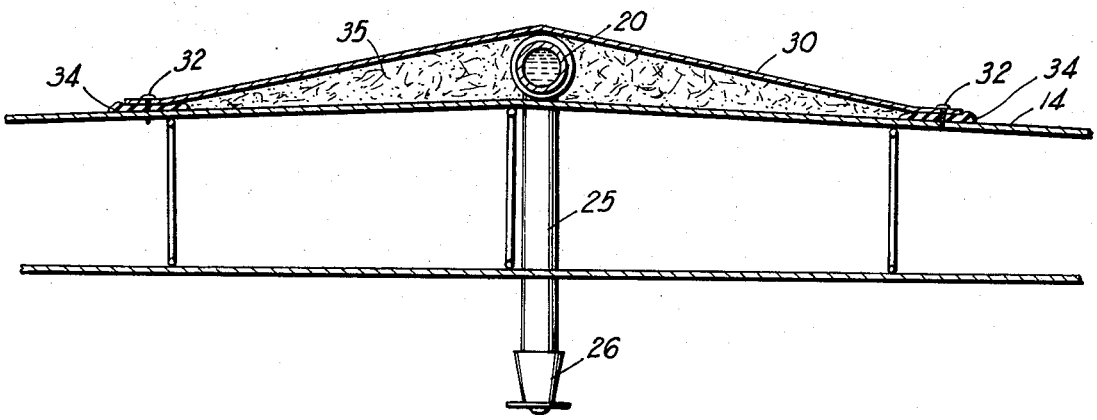
FIG. 4 is another, transverse, cross-sectional view of a portion of the construction shown in FIG. 3.

With reference next to FIG. 4, trunk line 20 and that portion of feeder line 22 atop roof 14 is seen to be covered by a metallic cover or gabled roof 30, the edges of which are secured to home roof 14 by a set of metal screws 32 with sealing material 34, such as Cool Seal, sandwiched between the cover and roof. This serves to inhibit water such as rain from entering into the space beneath cover 30 and from there descending through the openings in the roof and ceiling through which branch lines 25 pass. Prior to attaching and sealing the cover, the void between it and roof 14 is packed with bulk insulation material 35 encompassing trunk line 20. This insulation material serves to prevent the trunk line from cracking during freezing weather conditions.

Figure 5:
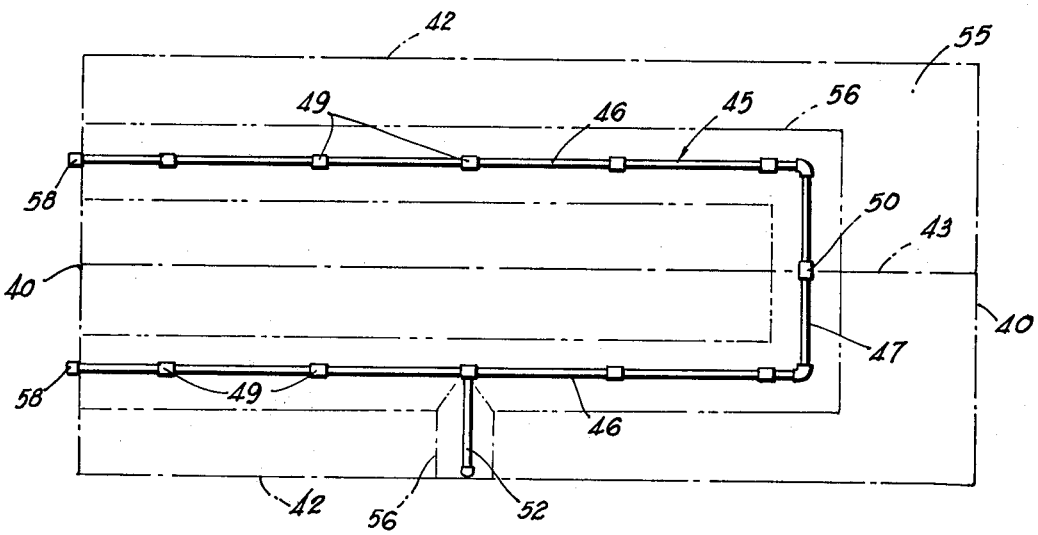
FIG. 5 is a plan view of a fire extinguishing system for a mobile home of the double-wide type.
Figure 6:
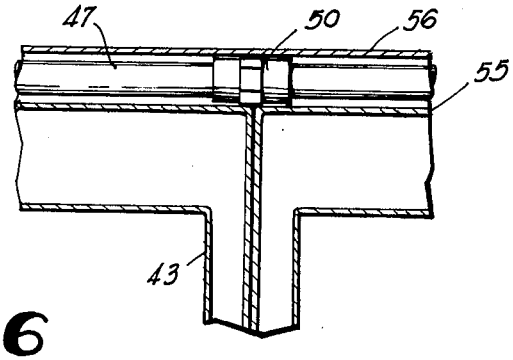
FIG. 6 is a cross-sectional view of a fragment of a mobile home of the double-wide type having a fire extinguishing system in accordance with the present invention installed therein.

With reference next to FIGS. 5 and 6, a mobile home of the double-wide type is schematically illustrated having a pair of end walls 40, a pair of side walls 42, and a double paneled center wall 43 extending between end walls 40. As is well known in the art, this type of mobile home is designed to be temporarily disassembled into two haves during periods of relocation by splitting the home longitudinally adjacent the center wall. The fire extinguishing system for this type mobile home is seen to include a generally U-shaped trunk line 45 having two parallel trunk line sections 46 linked together by a linking trunk line section 47 which transverses center wall 43. Again, a set of branch lines extends downward through the roof of the mobile home from couplings 49 in trunk line sections 46. A union 50 is provided above the double paneled center wall 43 detachably coupling trunk line sections 47 together. A feeder line 52 passing upwardly through a side wall 42 from water line 16 is connected with a trunk line section. A cover or roof 56 is again provided to inhibit water exterior the trunk and branch lines from descending into the interior living spaces within the mobile home through the roof and ceiling. With the coupling arrangement shown in FIG. 6 the mobile home may be easily bifurcated and reunited by merely disconnecting a branch line 47 from the union 50. As in the previously described embodiment, each end of the trunk line is also provided with a vent 58 through which air may be vented in initially filling the sprinkler system with water.

It should be understood that the just described embodiments merely illustrate the principles of the invention in preferred forms. Many modifications, additions and deletions may, of course, be made thereto without departure from the spirit and scope of the invention as set forth in the following claims.

What is claimed is:

1. In a mobile home having a roof, side walls and a floor enclosing living spaces to which water may be supplied through a water line, the improvement comprising a fire extinguishing system including a trunk line mounted to the roof in fluid communication with the water line, a plurality of branch lines coupled with said trunk line and extending down through at least one opening in the roof into the living spaces, means for inhibiting water exterior said branch and trunk lines from passing through the roof opening, and a plurality of heat responsive sprinkler heads mounted to said plurality of branch lines within the living spaces.

2. The improvement in mobile homes of claim 1 wherein said trunk line is mounted atop said roof.

3. The improvement in mobile homes of claim 2 wherein said inhibiting means comprises a system roof mounted atop the mobile home roof over said trunk line.

4. The improvement in mobile homes of claim 3 wherein said fire extinguishing system further includes bulk insulation material disposed about said trunk line beneath said systems roof atop the mobile home roof.

5. The improvement in mobile homes of claim 1 wherein a side wall of the mobile home comprises a pair of juxtaposed panels defining a void, and wherein said fire extinguishing system further includes a feeder line passing through the void providing fluid communication between said trunk line and the water line.

6. The improvement in mobile homes of claim 1 wherein the mobile home is of the double-wide type having an interior wall extending between two opposing end walls, and wherein said fire extinguishing system trunk line includes two trunk line sections mounted to the roof about opposite sides of the interior wall and a linking trunk line section mounted to the roof transverse the interior wall coupling said two trunk line sections together.

7. The improvement in mobile homes of claim 6 wherein said linking trunk line section comprises first and second line components mounted to the roof to either side of the interior wall, and wherein said fire extinguishing system further comprises a union mounted above the interior wall detachably coupling said first and second linking trunk line section components together.

* * * * *